United States Patent [19]

Naito et al.

[11] Patent Number: 4,615,449

[45] Date of Patent: Oct. 7, 1986

[54] APPARATUS FOR PREVENTING A MOVABLE RACK FROM FALLING DOWN

[75] Inventors: Hanichiro Naito; Masamichi Miura, both of Tokyo, Japan

[73] Assignee: Elecompack Company Ltd., Tokyo, Japan

[21] Appl. No.: 606,147

[22] Filed: May 2, 1984

[30] Foreign Application Priority Data

May 4, 1983 [JP] Japan ..... 58-67339[U]
May 10, 1983 [JP] Japan ..... 58-69594[U]

[51] Int. Cl.[4] ..... A47F 5/00
[52] U.S. Cl. ..... 211/162; 312/201
[58] Field of Search ..... 211/162, 151, 122, 94, 211/119.05; 16/91, 98; 312/201; 160/196 R, 197, 198, 199, 200; 104/121, 246; 105/146, 147

[56] References Cited

U.S. PATENT DOCUMENTS

| | | | |
|---|---|---|---|
| 469,223 | 2/1892 | Bardsley | 211/162 |
| 559,652 | 5/1896 | Winner | 105/147 |
| 597,843 | 1/1898 | French | 104/121 X |
| 624,231 | 5/1899 | Martin | 211/162 X |
| 680,996 | 8/1901 | Hook | 16/98 X |
| 766,660 | 8/1904 | Bohannan | 312/201 |
| 813,588 | 2/1906 | Rollins | 16/98 |
| 856,607 | 6/1907 | Schuyler | 16/98 X |
| 917,105 | 4/1909 | McCabe | 211/162 X |
| 1,019,331 | 3/1912 | Maloney | 104/121 |
| 1,526,853 | 2/1925 | Harson | 105/147 |
| 2,098,828 | 11/1937 | Ludwick | 104/121 X |
| 3,169,574 | 2/1965 | Behlen | 16/91 X |
| 3,570,683 | 3/1971 | Dickgiesser | 211/162 |
| 3,811,574 | 5/1974 | O'Brien | 211/94 X |
| 4,033,649 | 7/1977 | Naito et al. | 312/201 |
| 4,432,589 | 2/1984 | Sattel | 312/201 X |

*Primary Examiner*—Ramon S. Britts
*Assistant Examiner*—Sarah A. Lechok Eley
*Attorney, Agent, or Firm*—Richard L. Cannaday; John F. Smith; William J. Ungvarsky

[57] ABSTRACT

An apparatus for preventing a movable rack from falling down comprises a tubular rail extending horizontally above the movable rack, a pair of U-shaped brackets each of which is provided on a top of the movable rack spaced apart from each other in a direction of the movement of the rack, and a pair of rollers provided in each of the brackets vertically separate from each other. The rollers are so disposed that the tubular rail extends between the rollers.

7 Claims, 6 Drawing Figures

APPARATUS FOR PREVENTING A MOVABLE RACK FROM FALLING DOWN

FIELD OF THE INVENTION

The present invention relates to an apparatus for preventing a movable rack from falling down.

DESCRIPTION OF THE PRIOR ART

A set of movable racks are widely used so as to make use of a given floor area effectively and economically. In this technical field, a pair of ground rails are laid down on the floor, on which some movable racks each provided at a bottom portion thereof with four running wheels run smoothly. One or more movable racks are moved back and forth and then a required object which is housed in an arbitrary movable rack is adapted to be taken into and out therefrom.

In case of an occurrence of an earthquake or of a presence of an obstacle on a passageway between the movable racks, it is feared that the movable rack may fall down.

SUMMARY OF THE INVENTION

An object of the invention is to provide an apparatus which prevent a movable rack from falling down.

The above object and the features of the invention will be apparent from the following description taken in connection with the accompanying drawings in which like members or same members are identified by the same reference numerals.

DETAILED DESCRIPTION OF THE PREFERRED EMBODIMENTS

Figure 1:
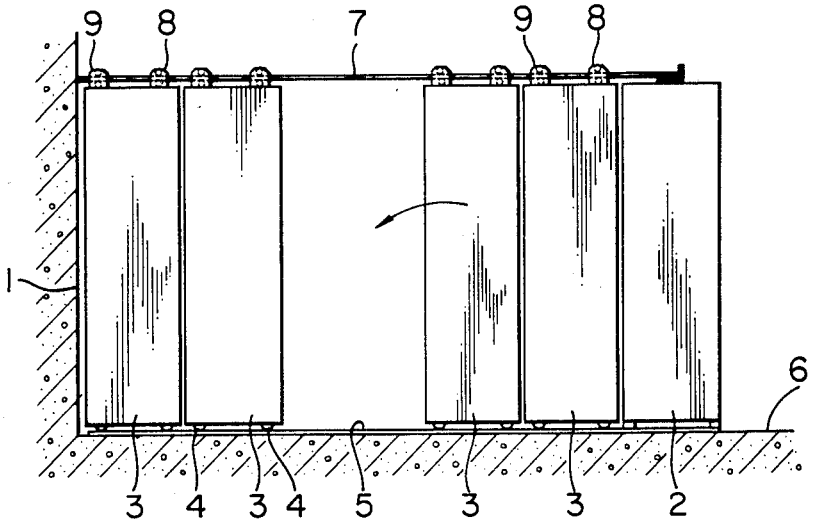
FIG. 1 is a front view showing a set of movable racks to which one embodiment of the invention is applied.
Figure 2:
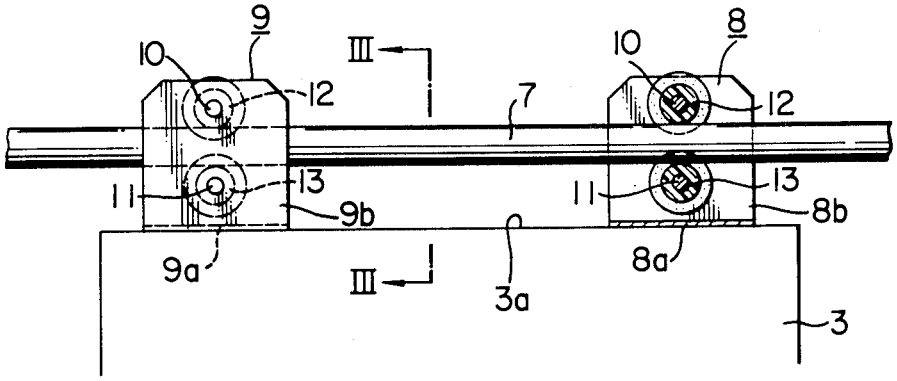
FIG. 2 is a partially sectional enlarged front view showing an upper portion of the movable rack shown in FIG. 1.
Figure 3:
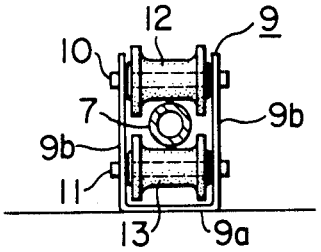
FIG. 3 is a fragmentary side view taken along the line III—III of FIG. 2.

In FIG. 1 reference numerals 1 and 2 designate an upright wall and a stationary rack respectively. Four racks 3 are disposed in series between the upright wall 1 and the stationary rack 2. Each of racks 3 is provided at the bottom thereof with running wheels 4 which run on a pair of ground rails 5 laid down on a floor 6. The rack 3 can move or run along the ground rails 5 (only one of them is shown in FIG. 1) by means of the running wheels 4. A tubular rail 7 extends horizontally above the movable racks 3 and along a direction of the movement of the movable racks 3. Both ends of the rail 7 are rigidly fixed to the upright wall 1 and to a top of the stationary rack 2 respectively. As shown in FIGS. 2 and 3, a pair of U-shaped brackets 8 and 9 (clearly shown in FIG. 3) are disposed on a top 3*a* of the movable rack 3 apart from each other by a predetermined distance in a direction of the movement of the movable racks 3. The brackets 8 and 9 are fixed at base plates 8*a* and 9*a* thereof to the top 3*a* of the movable rack 3 by means of bolts (not shown). Two shafts 10 and 11 are fixed to the respective upright wall plates 8*b* and 8*b*, or 9*b* and 9*b* through which the opposite ends of the shafts 10 and 11 project outwardly, and are vertically apart from each other. A pair of rollers 12 and 13 made from synthetic resin or so on are rotatably mounted to the respective shafts 10 and 11. Each of rollers 12 and 13 is concaved at a middle portion of the outer periphery thereof so as to cover substantially one rail periphery half. A pair of shaft-roller sets 10 and 12, and 11 and 13 are so disposed that the tubular rail 7 is held between the rollers 12 and 13. It is preferable that as shown in FIG. 3, the rollers 12 and 13 are disposed so as to permit a small gap between the rollers 12, 13 and the tubular rail 7.

An operation of the above embodiment will be explained hereinafter.

The running wheels 4 are normally guided by the ground rails 5 and then the movable rack is moved. In this case, the small gap between the rollers 12, 13 and the tubular rail 7 does permit a smooth movement of the rack 3 without any bad influence. Even though the roller 12 or 13 does come into contact with the tubular rail 7 due to a deflection of and/or an inequality of diameter of the tubular rail 7, the rollers can rotate, so that the movable rack also can move smoothly.

In case that the rack 3 is affected, for example, with oscillations due to an earthquake during movement of the rack 3 or standstill position thereof, or that the rack 3 comes into collision with an obstacle on a passageway between the movable racks during movement thereof, the rack 3 is affected with a rolling force acting in an arrow direction shown in FIG. 1, so that the rack 3 may fall down counterclockwise. On this occasion, a lower peripheral portion of the upper roller 12 in the bracket 9 is abutted upon an upper peripheral portion of the rail 7, and the upper peripheral portion of the lower roller 13 in the bracket 8 is abutted upon a lower peripheral portion of the rail 7, so that friction forces against such rolling force are generated at the respective abutment points so as to prevent a rack from falling down.

To the contrary, in case that the opposite force is applied to the rack 3, an upper peripheral portion of the lower roller 13 in the bracket 9 is abutted upon a lower peripheral portion of the rail 7, and a lower peripheral portion of the upper roller 12 in the bracket 8 is abutted upon an upper peripheral portion of the rail 7, so that friction forces against such rolling force are generated at the respective abutment points so as to prevent a rack from falling down in the same manner described hereinbefore.

Figure 4:
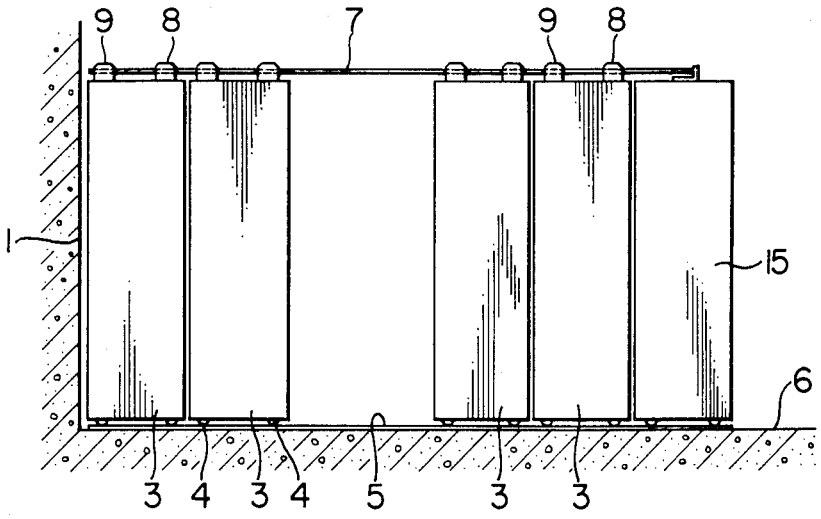
FIG. 4 is a front view showing a set of movable racks to which another embodiment of the invention is applied.
Figure 5:
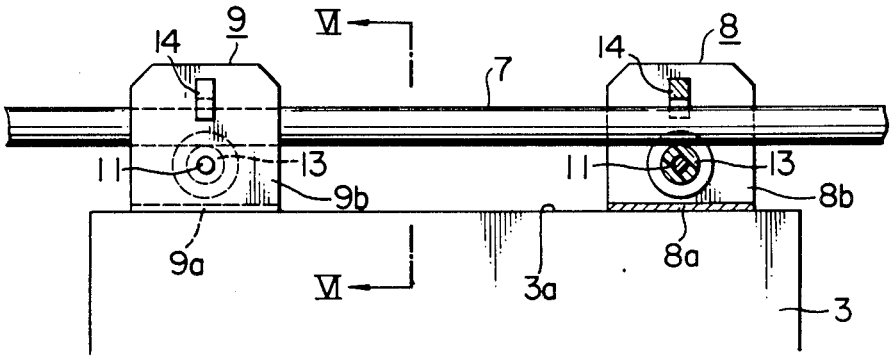
FIG. 5 is a partially sectional enlarged front view showing an upper portion of the movable rack shown in FIG. 4.
Figure 6:
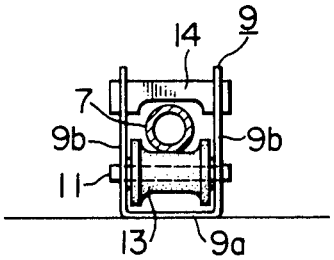
FIG. 6 is a fragmentary side view taken along the line VI—VI of FIG. 5.

Another embodiment of the invention is shown in FIG. 4. In this embodiment, instead of a pair of shaft-roller sets, a shaft 11 and a transverse member 14 are fixed to the respective upright wall plates 8*b* and 8*b*, and 9*b* and 9*b* of brackets 8 and 9, through which the opposite ends of the shaft 11 and the transverse member 14 project. The shaft 11 and the transverse member 14 are spaced vertically apart from each other. A roller 13 made from synthetic resin or so on is rotatably mounted on the shaft 11. The shaft-roller set 11 and 13 and the traverse member 14 are so disposed that the tubular rail 7 is held between the roller 13 and the transverse member 14. It is preferable that as shown in FIG. 6, the rail 7 and the transverse member 14 are disposed so as to permit a small gap therebetween.

An operation of the above mentioned second embodiment is the same as one of the first embodiment, so that the explanation of the operation is omitted.

In the first embodiments shown in FIG. 1, the tubular rail 7 is fixed at the opposite ends thereof to the upright wall 1 and the stationary rack 2. However, even though the rail 7 is fixed at one end thereof to either upright wall 1 or the stationary rack 2 and the other end thereof is made to be free, the same meritorious effect as the above embodiment has can be expected.

In case that there is no stationary portion or member such as the upright wall 1 or the stationary rack 2, it can be possible to fix the tubular rail 7 onto the top of the single movable rack (preferably an outermost movable rack 15 as shown in FIG. 4). In this case, even though the tubular rail 7 is not fixed and can be moved somewhat, the same meritorious effect also can be expected.

The second embodiment includes the transverse member 14 having a rectangular section and being recessed at a lower portion thereof, but it is possible to apply a transverse member having a circular section instead for the rectangular transverse member 14.

Furthermore, the present invention can be applicable not only to a set of movable racks which are operated manually but also to a set of movable racks which are operated by an electromotor.

What is claimed is:

1. An apparatus for preventing a movable rack from falling down comprising in combination:

a rack movably mounted on a lower track;

a rail extending horizontally above said movable rack and along a direction parallel to one of movement of said movable rack;

an aligned pair of bracket means provided on an upper portion of said movable rack apart from each other in said direction, and a pair of transverse means including upper and lower means provided on each of said bracket means, with said rail disposed therebetween the means of each such pair including at least one roller rotatable about an axis normal to said direction and being so disposed with respect to themselves, the other pair and said rail such that said rail extends with vertical clearance between the rail and the upper means of each pair of transverse means, said movable rack being supported entirely from below independently of said rail for horizontal movement.

2. An apparatus according to claim 1 wherein each said pair of transverse means includes two rollers each rotatable around an axis normal to said direction.

3. An apparatus according to claim 1 wherein each said pair of transverse means includes a roller rotatable around an axis normal to said direction and a transverse bar, a middle portion of a surface of said bar opposing said rail being concaved.

4. An apparatus according to claim 1 wherein said roller is concaved at a middle portion thereof.

5. An apparatus according to claim 2 wherein each of said rollers is concaved at a middle portion thereof.

6. An apparatus according to claim 3 wherein said roller is concaved at a middle portion thereof.

7. An apparatus according to claim 5 wherein said rail has a tubular transverse shape.

* * * * *